US011060158B2

(12) United States Patent
Song

(10) Patent No.: US 11,060,158 B2
(45) Date of Patent: Jul. 13, 2021

(54) DIRECTIONAL ELECTRIC STEEL PLATE HAVING EXCELLENT MAGNETIC PROPERTIES AND MANUFACTURING METHOD THEREOF

(71) Applicant: POSCO, Pohang-si (KR)

(72) Inventor: Dae Hyun Song, Pohang-si (KR)

(73) Assignee: POSCO, Pohang-si (KR)

( * ) Notice: Subject to any disclaimer, the term of this patent is extended or adjusted under 35 U.S.C. 154(b) by 328 days.

(21) Appl. No.: 15/539,665

(22) PCT Filed: Dec. 21, 2015

(86) PCT No.: PCT/KR2015/014033
§ 371 (c)(1),
(2) Date: Jun. 23, 2017

(87) PCT Pub. No.: WO2016/105052
PCT Pub. Date: Jun. 30, 2016

(65) Prior Publication Data

US 2017/0369959 A1 Dec. 28, 2017

(30) Foreign Application Priority Data

Dec. 24, 2014 (KR) ..... 10-2014-0188876

(51) Int. Cl.
*C21D 8/12* (2006.01)
*C23C 2/12* (2006.01)
(Continued)

(52) U.S. Cl.
CPC ..... *C21D 8/12* (2013.01); *C22C 38/02* (2013.01); *C23C 2/12* (2013.01); *C23C 2/28* (2013.01); *C21D 2201/05* (2013.01)

(58) Field of Classification Search
CPC ..... C21D 2201/05; C21D 8/12; C22C 38/02; C23C 2/12; C23C 2/28
(Continued)

(56) References Cited

U.S. PATENT DOCUMENTS 6,911,268 B2 * 6/2005 Takada ..... C21D 8/0278 148/533
7,731,808 B2 * 6/2010 Tomida ..... B32B 15/012 148/320
(Continued)

FOREIGN PATENT DOCUMENTS

EP 0913488 A2 5/1999
JP S55-046507 A 4/1980
(Continued)

OTHER PUBLICATIONS

NPL: English translation of JP H07258863 A, Oct. 1995 (Year: 1995).*
(Continued)

*Primary Examiner* — Jie Yang
(74) *Attorney, Agent, or Firm* — Morgan, Lewis & Bockius LLP

(57) ABSTRACT

The present invention relates to a method of manufacturing a directional electric steel plate having excellent surface wettability and magnetic properties. More particularly, the present invention relates to a directional electric steel plate in which a surface of a steel plate consisting of Si: 2.0 to 6.5%, acid soluble Al: 0.4 to 5%, Mn: 0.20% or less (0% exclusive), N: 0.010% or less (0% exclusive), S: 0.010% or less (0% exclusive), P: 0.005 to 0.05%, C: 0.04 to 0.12% and a balance of Fe and other unavoidable impurities is hot-dip plated with aluminum or an aluminum-silicon alloy, and
(Continued)

heat-treated, so that aluminum on the hot-dip plated layer is diffused or infiltrated into the steel plate, and a method of manufacturing the same.

10 Claims, 1 Drawing Sheet

(51) Int. Cl.
*C23C 2/28* (2006.01)
*C22C 38/02* (2006.01)

(58) Field of Classification Search
USPC ..... 148/308
See application file for complete search history.

(56) References Cited

U.S. PATENT DOCUMENTS

| | | | | |
|---|---|---|---|---|
| 2008/0202639 | A1* | 8/2008 | Tomida | C22C 38/06 148/506 |
| 2013/0206284 | A1* | 8/2013 | Norden | C21D 8/0457 148/217 |

FOREIGN PATENT DOCUMENTS

| | | | | |
|---|---|---|---|---|
| JP | 61-139677 | A | | 6/1986 |
| JP | 05247586 | A | * | 9/1993 |
| JP | 06145788 | A | * | 5/1994 |
| JP | H06-86631 | B2 | | 11/1994 |
| JP | H07-138648 | A | | 5/1995 |
| JP | H07-188759 | A | | 7/1995 |
| JP | 07-258863 | A | | 10/1995 |
| JP | WO2009-072394 | A1 | | 4/2011 |
| JP | 2012-177188 | A | | 9/2012 |
| JP | 2013-095955 | A | | 5/2013 |
| KR | 10-2010-0084643 | A | | 7/2010 |
| KR | 10-2012-0071822 | A | | 7/2012 |
| KR | 10-2014-0127648 | A | | 11/2014 |

OTHER PUBLICATIONS

NPL: English abstractor JP05247586A, 1993 (Year: 1993).*
NPL: English abstractor JP06145788A, 1994 (Year: 1994).*
International Search Report dated Feb. 24, 2016, issued in International Application No. PCT/KR2015/014033. (w/partial English translation).

* cited by examiner

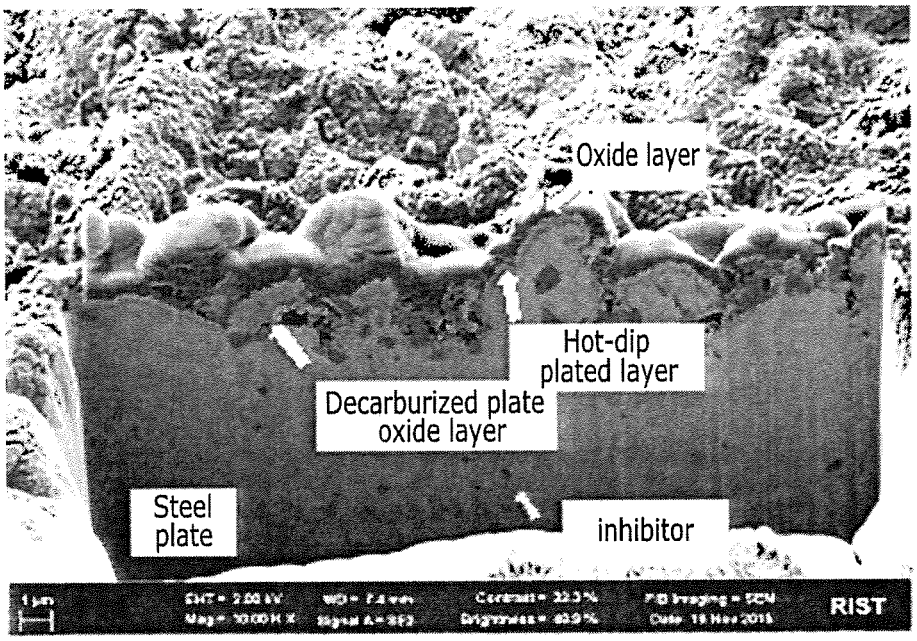
Oxide layer
Hot-dip
plated layer
Decarburized plate
oxide layer
Steel
plate
inhibitor
RIST

DIRECTIONAL ELECTRIC STEEL PLATE HAVING EXCELLENT MAGNETIC PROPERTIES AND MANUFACTURING METHOD THEREOF

CROSS-REFERENCE TO RELATED APPLICATIONS

This application is the U.S. National Phase of PCT/KR2015/014033 filed Dec. 21, 2015, which claims priority to Korean Patent Application No. 10-2014-0188876 filed Dec. 24, 2014. The subject matter of each is incorporated herein by reference in entirety.

BACKGROUND OF THE INVENTION

(a) Field of the Invention

The present invention relates to a directional electric steel plate having excellent magnetism and a manufacturing method thereof. Specifically, the present invention relates to a directional electric steel plate having excellent magnetism, a method of manufacturing a directional electric steel plate having excellent magnetism by hot-dip plating a plate obtained by cold rolling a copper slab with aluminum or aluminum-silicon binary molten metal during or after decarburizing and nitriding annealing, and then diffusing aluminum in the steel plate to increase an aluminum content and specific resistance of the steel plate, and a method of dramatically improving surface wettability when hot-dip plating aluminum-silicon binary molten metal by adding a predetermined content of segregation element such as Sb and Sn when manufacturing the electric steel plate copper slab as described above.

(b) Description of the Related Art

An electric steel plate refers to a silicon steel plate used in iron core materials of electronic devices such as motors or various transformers and generators, and may be largely divided into a directional electric steel plate and a non-directional electric steel plate. Among these, a directional electric steel plate used in transformers and the like refers to a steel plate composed of crystal grains having so-called a Goss aggregation texture in which the orientation of a crystal face is a {110} plane, and crystal orientation in a rolling direction is parallel to a <001> axis. This steel plate has excellent magnetic properties in a rolling direction.

In order to manufacture a steel plate having very good magnetic properties by conforming the orientation of the steel plate closely to Goss orientation, the orientation of all crystals is needed to be consistent to the Goss orientation. However, since the orientation of crystals in an electric steel plate is differently distributed from crystals, in order to conform the orientation closely to the Goss orientation, a recrystallization process to leave only the crystals close to the Goss texture is performed. In order to distinguish this recrystallization from primary recrystallization performed first, as described below, this crystallization is referred to as secondary recrystallization.

The primary recrystallization is usually performed immediately after or simultaneously with decarburizing annealing which is performed generally after cold rolling, and crystal grains having a uniform and appropriate particle size are formed by the primary recrystallization. The primary-recrystallized steel plate may be then secondary-recrystallized at a temperature appropriate for having the Goss orientation, thereby being formed into a steel plate having the Goss orientation with excellent magnetism. However, when the crystal grains having different orientations from each other in the primary-recrystallized steel plate have different sizes, even in the case that the secondary recrystallization occurs at a temperature appropriate for having the Goss orientation, the possibility that large crystal grains predominantly grow regardless of orientation is increased by so-called the size advantage, that is, the effect that large crystal grains are more stable than small crystal grains, and as a result, a ratio of crystal grains deviated from the Goss orientation increases.

Accordingly, a means for inhibiting growth of crystal grains, so that recrystallization does not occur up to the appropriate secondary recrystallization temperature, is needed. The means performing this role in the inside of a steel plate may be implemented by segregation, precipitation or the like of added components, and the precipitates performing this role are called an inhibitor. Widely used as the inhibitor described above are the precipitates such as AlN, MnS or MnSe.

Meanwhile, in an effort to further improve the magnetic properties of an electric steel plate, there are techniques therefor such as adding an alloy element which may obtain an inhibiting force effect in a similar level to the precipitates, differently from the technique through crystal grain growth inhibiting force by the precipitates, thereby further increasing the fraction of the Goss aggregation texture after performing secondary recrystallization high temperature annealing; increasing the fraction of the Goss aggregation texture in the primary recrystallization aggregation texture during a primary recrystallization annealing process, thereby increasing the fraction of a secondary recrystallization microtexture of the Goss aggregation texture after secondary recrystallization high temperature annealing; and uniformly distributing the size of the primary-recrystallized crystal grains so that the aggregation texture not assisting magnetic property improvement at all due to texture non-uniformity of primary-recrystallized microtexture does not grow.

As a conventionally suggested method in order to implement various means for improving the magnetic properties of the directional electric steel plate as described above, a method of adding an alloy component to a steel plate may be mentioned.

Japanese Patent Laid-Open Publication No. H01-283324 suggests adding B and Ti for reinforcing weakened crystal growth inhibiting force by a single strong cold rolling, however, B is very difficult to be controlled in a steel manufacturing step by addition with a very little amount, and also, is easy to form coarse BN in steel after addition, and also, Ti forms TiN or TiC having a solid solution temperature of 1300° C. or more, thereby being present even after secondary recrystallization to act as a factor rather to increase core loss.

Japanese Patent Laid-Open Publication No. 1994-086631 suggests adding Se and B as a crystal grain growth inhibitor for improving magnetic properties, however, discloses that added B is effective only when N in the annealed steel is included at an appropriate amount, and is ineffective when N is included less than 10 ppm.

As such, the conventional art is characterized by increasing a silicon content, and then overcoming limitations of cold rolling by hot rolling, or increasing specific resistance by siliconizing to reduce core loss, in order to improve the magnetic properties of the directional electric steel plate, and adding an intergranular segregation element such as B, Ti and Se, in order to improve crystal grain growth inhibiting force.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a directional electric steel plate having advantages of excellent magnetic properties, by adding a predetermined content of segregation element such as Sb and Sn when manufacturing a slab, thereby appropriately controlling an oxide layer during decarburizing annealing.

In addition, the present invention has been made in an effort to provide a method of manufacturing a directional electric steel plate having advantages of solving an unplating problem occurring intermittently when hot-dip plating aluminum or aluminum-silicon binary molten metal.

An exemplary embodiment of the present invention provides a directional electric steel plate including a steel plate consisting of Si: 2.0 to 6.5%, acid soluble Al: 0.4 to 5%, Mn: 0.20% or less (0% exclusive), N: 0.010% or less (0% exclusive), S: 0.010% or less (0% exclusive), P: 0.005 to 0.05%, C: 0.04 to 0.12%, and a balance of Fe and other unavoidable impurities, by wt %, a hot-dip plated layer formed on a surface of the steel plate and consisting of aluminum or an aluminum-silicon alloy, and an oxide layer formed on the hot-dip plated layer and consisting of aluminum oxide or an oxide of aluminum-silicon alloy.

The electric steel plate may further include 0.01% to 0.15% of Sb, Sn or both elements.

The aluminum-silicon alloy may include more than 0 wt % to 60 wt % of silicon. More specifically, the aluminum-silicon alloy may include 10 to 30 wt % of silicon.

The hot-dip plated layer may have an unplating rate of 15% or less.

Another embodiment of the present invention provides a method of manufacturing a directional electric steel plate including:

preparing a steel slab consisting of Si: 2.0 to 6.5%, acid soluble Al: 0.04% or less (0% exclusive), Mn: 0.20% or less (0% exclusive), N: 0.010% or less (0% exclusive), S: 0.010% or less (0% exclusive), P: 0.005 to 0.05%, C: 0.04 to 0.12%, and a balance of Fe and other unavoidable impurities, by wt %;

reheating the steel slab to a temperature of 1250° C. or less;

subjecting the reheated slab to hot rolling, hot band annealing and cold rolling to manufacture a steel plate;

subjecting the cold rolled steel plate to decarburizing annealing and nitriding treatment at the same time or sequentially; and finally annealing the steel plate subjected to decarburizing annealing and nitriding treatment, wherein during of after the decarburizing annealing and nitriding treatment, hot-dip plating aluminum or aluminum-silicon binary molten metal, and oxidizing a surface of a hot-dip plated layer are further included.

The slab may further include 0.01 to 0.15% of Sb, Sn or both elements.

The aluminum-silicon alloy hot-dip plated on the steel plate may include more than 0 wt % to 60 wt % of silicon. More specifically, the aluminum-silicon alloy hot-dip plated on the steel plate may include more than 10 wt % to 30 wt % of silicon.

The hot-dip plating of the aluminum or aluminum-silicon binary molten metal may be carried out at a temperature of 600 to 900° C.

In the hot-dip plating of the aluminum or aluminum-silicon binary molten metal, hot-dip plating may be carried out so that the unplating rate of the hot-dip plated layer is 15% or less.

According to the directional electric steel plate of the present invention, a decarburizing and nitriding annealed plate on which the aluminum or aluminum-silicon binary molten metal is plated is subjected to final secondary recrystallization high temperature annealing with a general high temperature annealing separator, thereby providing a directional electric steel plate having ultralow core loss and high magnetic flux density, and remarkably better magnetism, composed of the Goss aggregation texture having a high integration degree to {110}<001> orientation and a significantly fine crystal grain size.

In addition, according to the method of manufacturing a directional electric steel plate of the present invention, a process of hot-dip plating aluminum or aluminum-silicon binary molten metal, and then diffusing aluminum in a steel plate to increase an aluminum content and specific resistance of the steel plate, and at the same time, capable of dramatically improving surface wettability of a steel plate surface when hot-dip plating the aluminum-silicon binary molten metal is characterized.

BRIEF DESCRIPTION OF THE DRAWINGS

FIG. 1 is a cross section photograph of an electric steel plate manufactured in Example 1.

DETAILED DESCRIPTION OF THE EMBODIMENTS

The present invention may be subjected to various modification, and have various forms, and thus, specific exemplary embodiments will be illustrated and described in detail in the following. However, it should be understood that the present invention is not limited to the specified disclosure forms, and all modification, equivalents and substituents included in the spirits and technical scope of the present invention are included.

The directional electric steel plate suggested in the present invention is manufactured by a process essentially including hot-dip plating aluminum or aluminum-silicon binary molten metal, and then diffusing aluminum in the steel plate to increase an aluminum content and specific resistance of the steel plate, and simultaneously, the process is characterized by dramatically improving surface wettability of a steel plate surface, when hot-dip plating aluminum-silicon binary molten metal.

The directional electric steel plate of the present invention includes a steel plate consisting of Si: 2.0 to 6.5%, acid soluble Al: 0.4 to 5%, Mn: 0.20% or less (0% exclusive), N: 0.010% or less (0% exclusive), S: 0.010% or less (0% exclusive), P: 0.005 to 0.05%, C: 0.04 to 0.12%, and a balance of Fe and other unavoidable impurities, by wt %, a hot-dip plated layer formed on a surface of the steel plate and consisting of aluminum or an aluminum-silicon alloy, and an oxide layer formed on the hot-dip plated layer and consisting of an aluminum oxide or an oxide of aluminum-silicon alloy.

Hereinafter, the directional electric steel plate of the present invention will be described in detail.

The directional electric steel plate which is the subject of the present invention refers to a steel plate composed of crystal grains having so-called Goss orientation or Goss aggregation texture in which the orientation of a crystal face is a {110} plane and crystal orientation in a rolling direction is parallel to a <001> axis.

In order to manufacture a steel plate having excellent magnetic properties by conforming the orientation of the directional electric steel plate closely to the Goss orientation, the orientation of all crystals is needed to be consistent with the Goss orientation. However, an electric steel plate manufactured by rolling a slab inevitably has multicrystalline texture due to the manufacturing process, and as a result, the orientation of crystals is differently distributed for each crystal, and in order to conform this closely to Goss orientation, special working is needed.

That is, though the steel plate of rolled multicrystalline texture includes some crystals having orientation close to Goss orientation, most of the crystals included therein have orientation significantly deviated from the Goss orientation, and thus, when using it as it is, it is difficult to obtain an electric steel plate having excellent magnetic properties such as core loss. Therefore, a recrystallization process to recrystallize the steel plate of multicrystalline texture to leave only the crystals close to Goss texture is usually carried out.

Since the orientation of the crystals preferentially growing upon recrystallization is determined by recrystallization temperature, the crystals having orientation close to Goss orientation preferentially grow when well controlling recrystallization temperature.

As a result, the fraction of crystals having orientation close to Goss orientation was very small before recrystallization, but the fraction of crystals having orientation close to Goss orientation is a majority after recrystallization. In order to distinguish this recrystallization from primary recrystallization occurring first as described below, this recrystallization is called secondary recrystallization.

At this time, primary recrystallization is carried out so that crystals are distributed in a uniform size before the secondary recrystallization. The primary recrystallization is carried out immediately after decarburizing annealing usually carried out after cold rolling or simultaneously with decarburizing annealing, and crystal grains having a uniform and appropriately crystal size are formed by primary recrystallization. Of course, the orientation of the crystal grains is variously distributed, and thus, the ratio of the Goss orientation to be finally obtained in the directional electric steel plate is very low.

As described above, the primary-recrystallized steel plate is then secondary-recrystallized at an appropriate temperature for having Goss orientation, thereby being manufactured into a directional electric steel plate having excellent magnetism and Goss orientation.

However, when the crystal grains having different orientations from each other have different sizes in the primary-recrystallized steel plate, even in the case that the secondary recrystallization occurs at a temperature suitable for having Goss orientation, the possibility that large crystal grains predominantly grow regardless of orientation, by so-called the size advantage, that is, the effect that large crystal grains are more stable than small crystal grains increases, and as a result, a ratio of crystal grains deviated from the Goss orientation increases.

Accordingly, the crystal grains should be distributed in a uniform and appropriate size upon primary recrystallization. When the size of the crystal grains is unduly fine, interface energy is increased by a crystal interface area increased by fine crystal grains, so that the crystal grains become instable. In this case, the secondary recrystallization occurs at an unduly low temperature to produce a large amount of crystal grains not having Goss orientation, which is an undesirable result.

Accordingly, there is needed a means for inhibiting crystal grain growth so that recrystallization does not occur up to an appropriate secondary recrystallization temperature. The means performing this role within the steel plate may be implemented by segregation, precipitation or the like of the added components, and the precipitates performing this role are called an inhibitor.

The inhibitor is present near a crystal grain boundary in the form of precipitates or segregation until it reaches an appropriate secondary recrystallization temperature, thereby inhibiting further growth of crystal grains, and when it reaches an appropriate temperature (secondary recrystallization temperature), it is dissolved or decomposed to serve to promote free growth of crystal grains.

As a representative inhibitor having this role, a nitride-based inhibitor may be listed. For the nitride-based inhibitor, a cold rolled plate is manufactured by a general process, and then the cold rolled plate is under a nitrogen atmosphere simultaneously with or after decarburizing annealing, thereby forming a condition where nitrogen is easy to permeate into the steel plate, and thus, the permeating nitrogen reacts with a nitride forming element in the steel plate to form nitrides which serve as an inhibitor. As the nitrides, precipitates such as AlN and (Al, Si)N may be listed.

In the present invention, the nitrides such as (Al,Si,Mn)N and AlN serving as the inhibitor are precipitated in a large amount, and immediately before finishing decarburizing and nitriding annealing or thereafter, some or all of the oxide layer present in an outer oxide layer of the decarburizing and nitriding annealed plate is reduced under a reducing atmosphere, and then the decarburizing and nitriding annealed plate treated as such is hot-dip plated in aluminum or aluminum-silicon binary molten metal. At this time, in order to dramatically improve wettability of the steel plate surface by the hot-dip plated metal layer, a single element such as Sb and Sn or a mixture of two elements of Sb and Sn is added at a predetermined content from a step of manufacturing a slab into steel, thereby diffusing Sb or Sn alone, or Sb and Sn simultaneously into the surface during decarburizing annealing to cause surface segregation, thereby inhibiting formation of $SiO_2$ produced on the surface or the oxide layer having a possibility of lowering wettability, so as to improve the wettability of the steel plate surface by molten metal. That is, in order to dramatically improve wettability of the steel plate surface by the hot-dip plated metal layer, Sb, Sn or a mixture thereof is added at a predetermined content from a step of manufacturing an electric steel plate copper slab into steel, thereby diffusing Sb or Sn alone, or Sb and Sn simultaneously into the surface during decarburizing annealing to cause surface segregation, thereby inhibiting formation of $SiO_2$ produced on the surface or the oxide layer having a possibility of lowering wettability, so as to improve the wettability of the steel plate surface by molten metal.

Thereafter, a hot-dip plated layer on which the aluminum or aluminum-silicon binary molten metal is plated is oxidized to form an oxide layer consisting of an aluminum oxide or an oxide of aluminum-silicon alloy on the hot-dip plated layer, which is utilized as an annealing separator of a high temperature annealing plate, and final secondary recrystallization high temperature annealing is carried out, thereby obtaining a directional electric steel plate having ultralow core loss and high magnetic flux density, and remarkably better magnetism, consisting of Goss aggregation texture having a high integration degree to {110}<001> orientation and a significantly fine crystal grain size.

Sb and Sn have effects of increasing a fraction of crystal grains having a {110}<001> orientation in the primary recrystallization aggregation texture, and also uniformly precipitating sulfides. In addition, when the added amount of Sb and Sn is above a certain level, an effect of inhibiting an oxidation reaction during decarburizing annealing may be obtained, and thus, the temperature during decarburizing annealing may be further raised, and as a result, primary coating film formation of the directional electric steel plate may be facilitated.

In addition, since these elements are precipitated in a crystal grain boundary to inhibit crystal grain growth, the particle diameter of secondary-recrystallized grains may be decreased. Accordingly, an effect of magnetic domain fineness by secondary-recrystallized grain refining may be obtained.

In the present invention, an unplating rate and magnetic properties were improved by including all Sn or Sb alone, or both Sn and Sb among the directional electric steel plate components, and controlling their contents in a certain range.

Hereinafter, the constitution of the present invention will be described by detailed classification.

The reason for component limitation of the directional electric steel plate of the present invention is as follows.

Si is a basic composition of the electric steel plate and serves to increase specific resistance of a material to lower core loss. When the content of Si is less than 2.0 wt %, the specific resistance is reduced to increase eddy current loss, thereby deteriorating core loss characteristics, and phase transformation characteristics between ferrite and austenite occurs upon high temperature annealing, so that secondary recrystallization becomes unstable, and also the aggregation texture is severely damaged. Meanwhile, when the content of Si is above 6.5 wt % which is an excessive content, magnetostrictive properties and magnetic permeability are significantly lowered, so that the magnetic properties are severely damaged. Therefore, it is preferred that the content of Si is limited to 2.0 to 6.5 wt %.

Al serves as a potent crystal grain growth inhibitor, since nitrogen ions introduced by ammonia gas in an annealing process after cold rolling are bonded to Al, Si and Mn present in a solid solution state in the steel to form nitrides in the form of (Al,Si,Mn)N and AlN, in addition to AlN which is finely precipitated upon hot rolling and hot band annealing, and when the content of Al is unduly high, coarse nitrides are formed, thereby deteriorating crystal grain growth inhibiting force. Therefore, it is preferred that the content of Al in a slab is limited to 0.04 wt % or less (0 wt % exclusive). Meanwhile, the hot-dip plated layer is formed and subjected to heat treatment, Al in the hot-dip plated layer is diffused or infiltrated into the steel plate to increase the Al content in the steel plate. The Al content in the steel plate after Al is diffused or infiltrated into the steel plate by heat treatment may be specifically 0.4 to 5 wt %. More specifically, the Al content in the steel plate may be 1 to 3 wt %. More specifically, the Al content in the steel plate may be 2 to 2.5 wt %.

Mn has an effect of increasing specific resistance, identically to Si to reduce eddy current loss, thereby reducing total core loss, and is reacted with nitrogen introduced by nitriding, together with Si, to form precipitates of (Al,Si,Mn)N, and thus, is an important element for inhibiting the growth of primary-recrystallized grains to cause secondary recrystallization. However, when Mn is added more than 0.20 wt %, a large amount of (Fe, Mn) and Mn oxides is formed on the steel plate surface in addition to $Fe_2SiO_4$, thereby preventing a base coating from being formed during high temperature annealing to deteriorate surface quality, and causing phase transformation between ferrite and austenite in the high temperature annealing process, and thus, aggregation texture is severely damaged so that magnetic properties are greatly deteriorated. Therefore, the content of Mn is 0.20 wt % or less (0 wt % exclusive).

N is an important element to react with Al and B to form AlN and BN, and is preferably added at 0.01 wt % or less in the steel manufacturing step. When N is added more than 0.01 wt %, a surface defect called blister by nitrogen diffusion is caused in the process after hot rolling, and nitrides are formed too much in a slab state, rendering rolling to be difficult, so that it becomes a cause of subsequent process complication and manufacturing cost rise, and thus, the content of N is limited to 0.01 wt % or less (0 wt % exclusive). Meanwhile, N which is additionally needed for forming nitrides such as (Al,Si,Mn)N, AlN, (B,Si,Mn)N, (Al,B)N and BN is reinforced by subjecting steel to nitriding treatment using ammonia gas in the annealing process after cold rolling.

C is an element causing phase transformation between ferrite and austenite to contribute to crystal grain refining and elongation improvement, and is an essential element for improving rolling properties of an electric steel plate which is very brittle, and thus, has poor rolling properties, however, when it is present in a final product, carbides formed by a magnetic aging effect are precipitated in a product plate to deteriorate magnetic properties, and thus, it is preferred to control the content appropriately. When C is contained less than 0.04 wt % within the range of Si content as described above, phase transformation between ferrite and austenite does not work properly, thereby causing non-uniformity of the slab and hot rolled microtexture. Accordingly, it is preferred that the minimum content of C is 0.04 wt % or more. Meanwhile, since residual carbon present in the steel plate after hot band annealing heat treatment activates fixation of potential during cold rolling to increase a shear zone to increase production sites of Goss nucleus, thereby increasing the Goss crystal grain fraction of primary-recrystallized microtexture, more C is likely to be beneficial, however, when C is contained more than 0.12 wt % within the range of Si content as described above, sufficient decarburization is not obtained in the decarburizing annealing process without addition of a separate process or facility, and also, secondary-recrystallized aggregation texture is severely damaged due to phase transformation therefrom, and furthermore, when applying the final product to electric power equipment, deterioration of magnetic properties is caused by magnetic aging. Accordingly, it is preferred that the maximum content of C is 0.12 wt % or less.

When S is contained more than 0.01 wt %, precipitates of MnS are formed in the slab, and inhibit crystal grain growth, and when casting, they are segregated at a slab center, and thus, it is difficult to control the microtexture in the subsequent process. In addition, in the present invention, since MnS is not used as a crystal grain growth inhibitor, it is not preferred that S is added in an amount more than an inevitable content and precipitated. Accordingly, it is preferred that the content of S is 0.010 wt % or less (0 wt % exclusive).

P may be segregated in a crystal grain boundary to prevent movement of the crystal grain boundary, and simultaneously have an auxiliary role to inhibit crystal grain growth, and in terms of microtexture, P has an effect of improving {110}<001> aggregation texture. When the content of P is less than 0.005 wt %, the addition thereof is ineffective, and when P is added more than 0.05 wt %, brittleness is increased to greatly deteriorate rolling properties, and thus, it is preferred to limit the content to 0.005 to 0.05 wt %.

Sb and Sn have effects of crystal grain growth inhibition as a crystal grain boundary segregation element, and improving core loss. Meanwhile, Sb has a low melting point so that diffusion to the surface during decarburizing annealing occurs to inhibit surface oxide layer formation. However, excess addition of Sb or Sn may cause the surface oxide layer formed during primary recrystallizing annealing being a basis of base coating to be rather formed too little, and prevent smooth decarburization of carbon, and also, render the crystal grain growth inhibiting force to be excessive to grow even other aggregation texture which is not related to Goss aggregation texture, thereby damaging secondary-recrystallized aggregation texture to deteriorate even magnetic properties.

The present inventors confirmed the research results, and as a result, found that when Sb, Sn or both elements are added at 0.01 wt % or more, the surface oxide layer may be appropriately controlled, and a crystal grain growth inhibition effect is represented, and when added at 0.15 wt % or more, the surface oxide layer is rapidly deteriorated so that a stable base coating may not be obtained, and also, deterioration of decarburization behavior and a crystal grain growth inhibition effect are so high that stable secondary-recrystallized micromixture may not be obtained. Accordingly, it is preferred that the content of Sb, Sn or both elements is in a range from 0.01 wt % to 0.15 wt % or less.

This directional electric steel plate of the present invention may be manufactured from a steel slab identically including the elements as described above, that is, a steel slab consisting of Si: 2.0 to 6.5%, acid soluble Al: 0.04% or less (0% exclusive), Mn: 0.20% or less (0% exclusive), N: 0.010% or less (0% exclusive), S: 0.010% or less (0% exclusive), P: 0.005 to 0.05%, C: 0.04 to 0.12%, Sb, Sn or both elements: 0.01% to 0.15%, and a balance of Fe and other unavoidable impurities, by wt %. Here, the content of the components other than Al is identical to the content of the steel plate as described above, and the overlapping description is omitted.

It will be understood by any person with ordinary skill in the art to which the present invention pertains that in addition to the components as described above, various components included in the directional electric steel plate may be included as an alloy component of the electric steel plate of the present invention. Combination of commonly known components and the application thereof are naturally within the scope of right of the present invention.

According to an exemplary embodiment of the present invention, the directional electric steel plate may have secondary-recrystallized grains, that is, crystal grains having Goss orientation having an average particle size of about 1 to 3 cm.

In addition, it is preferred for securing excellent core loss that crystal grains forming the directional electric steel plate have a degree deviated from the Goss orientation of about 3 degrees or less.

Hereinafter, the process of manufacturing the directional electric steel plate according to an exemplary embodiment of the present invention will be described.

According to another exemplary embodiment of the present invention, a method of manufacturing a directional electric steel plate is provided, the method including: subjecting a steel slab consisting of Si: 2.0 to 6.5%, acid soluble Al: 0.04% or less (0% exclusive), Mn: 0.20% or less (0% exclusive), N: 0.010% or less (0% exclusive), S: 0.010% or less (0% exclusive), P: 0.005 to 0.05%, C: 0.04 to 0.12%, Sb, Sn or both elements: 0.01% to 0.15%, and a balance of Fe and other unavoidable impurities, by wt %, to hot rolling, hot band annealing and cold rolling to manufacture a steel plate;

subjecting the cold rolled steel plate to decarburizing annealing and nitriding annealing at the same time or sequentially; and subjecting the decarburizing annealed and nitriding annealed steel plate to final annealing.

The method of manufacturing the directional electric steel plate is characterized in that during or after the decarburizing annealing, aluminum or aluminum-silicon binary molten metal is hot-dip plated, and then the surface of a hot-dip plated layer is oxidized.

Hereinafter, the method of manufacturing the directional electric steel plate of the present invention will be described in detail. The condition not particularly described herein follows a general condition.

First, as described above for the directional electric steel plate of the present invention, a steel slab consisting of Si: 2.0 to 6.5%, acid soluble Al: 0.04% or less (0% exclusive), Mn: 0.20% or less (0% exclusive), N: 0.010% or less (0% exclusive), S: 0.010% or less (0% exclusive), P: 0.005 to 0.05%, C: 0.04 to 0.12%, Sb, Sn or both elements: 0.01% to 0.15%, and a balance of Fe and other unavoidable impurities, by wt %, is prepared.

More detailed description for the elements included in the steel slab and the contents thereof is as described above for the directional electric steel plate.

Next, the prepared slab is reheated. Here, it is preferred that the process of reheating the slab is performed at a predetermined temperature range where N and S to be solid-solubilized become incompletely solubilized. When N and S become completely solubilized, nitrides or sulfides are finely formed at a large amount after subsequent hot band annealing heat treatment, rendering subsequent single cold rolling to be impossible, requiring an additional process, and thus, the manufacturing cost is raised. In addition, the size of primary-recrystallized grains become significantly fine, so that appropriate secondary-recrystallized grains may not appear.

According to the results from the present inventors' research, it is more important to control a solid-solubilized amount of N to be solid-solubilized again by reheating the slab than to control a total amount of N contained in the annealed steel. That is, the size and amount of additional AlN formed in the decarburizing and nitriding annealing process depend on N to be solid-solubilized again, and in the case that the size of AlN is identical, when the amount is too large, crystal grain growth inhibiting force is increased, so that appropriate secondary recrystallization microtexture consisting of Goss aggregation texture may not be obtained. On the contrary, when the amount is too small, crystal grain growth driving force of the primary recrystallization microtexture is increased, so that appropriate secondary recrystallization microtexture may not be obtained, similarly to the above phenomenon. The content of N to be solid-solubilized again in the annealed steel by slab reheating is preferably 20 to 50 ppm. For the content of N to be solid-solubilized again, the content of Al contained in the annealed steel should be considered, since the nitrides used as a crystal grain growth inhibitor are (Al,Si,Mn)N and AlN. Regarding the solid solubility of Al and N in a pure 3% silicon steel plate, the correlation equation suggested by Iwayama is as follows:

$$\log[\%\ \mathrm{Al}]\,[\%\ \mathrm{N}] = -10062\frac{1}{T(K)} + 2.72$$

For example, assuming that acid soluble aluminum is 0.028 wt %, and N is 0.0050 wt %, the theoretical solid solubility temperature by the Iwayama equation is 1258° C., and thus, the slab of the electrical steel plate as such should be heated to 1300° C. When the slab is heated to 1280° C. or more, Fayalite, a compound of low melting silicon and base metal iron is produced on the steel plate, while the surface of the steel plate is melted down, and thus, hot rolling workability becomes very difficult, and heating furnace repairing due to melted metals is increased. It is preferred to reheat the slab to a temperature of 1250° C. or less for incomplete solubilization capable of the above-described reason, that is, heating furnace repairing and appropriate control of cold rolling and primary recrystallization aggregation texture.

Next, the process of hot rolling the reheated slab and manufacturing the cold rolled steel plate will be described. That is, the reheated slab is subjected to hot rolling, then hot band annealing, and then cold rolling, and an additional process required in hot rolling and cold rolling of a general electric steel plate, such as acid washing may be carried out by appropriately selecting one of the methods well known in the art to which the present invention pertains, and if necessary, applying appropriate transformation thereto.

Hereinafter, annealing of the hot rolled plate manufactured after hot rolling will be described in detail.

In the hot rolled plate, modified texture stretched by stress in a rolling direction is present, and AlN, MnS or the like is precipitated during hot rolling. Therefore, in order to have uniform recrystallization microtexture and fine AlN precipitate distribution before cold rolling, it is important that the hot rolled plate is once again heated to slab heating temperature or less, thereby recrystallizing modified texture, and in addition, a sufficient austenite phase is secured to promote solid solubility of the crystal grain growth inhibitor such as AlN and MnS. Accordingly, it is preferred that the hot band annealing temperature is 900 to 1200° C. for a maximum austenite fraction, and a method of carrying out cracking heat treatment and then cooling is taken. After applying heat treatment pattern as described above, the precipitates in the strip are present in a range of an average size of 200 to 3000 Å after hot band annealing heat treatment.

After hot band annealing, cold rolling to a thickness of 0.10 mm to 0.50 mm is carried out using a reverse roller or tandem roller, and single strong cold rolling where rolling is carried out at an initial hot rolled thickness directly to a thickness of the final product without annealing heat treatment of modified texture in the middle, is most preferred With the single strong cold rolling, the orientations having a low integration degree of {110}<001> orientation are rotated to a modified orientation, and only the Goss crystal grains well oriented to the {110}<001> orientation remain in the cold rolled plate. Accordingly, by two or more rolling, the orientations having a low integration degree are also present in the cold rolled plate, and secondary recrystallization is carried out upon final high temperature annealing, thereby obtaining characteristics of low magnetic flux density and low core loss. Accordingly, it is most preferred that the cold rolling is carried out at a cold rolling rate of 87% or more by a single strong cold rolling.

The thus-cold rolled steel plate is subjected to decarburizing annealing, recrystallization of modified texture, and nitriding treatment using ammonia gas. Further, in precipitation of (Al,Si,Mn)N, AlN and the like as an inhibitor by introducing nitrogen ions to the steel plate by using ammonia gas, there is no problem in showing the effects of the present invention whether nitriding treatment is carried out using ammonia gas after decarburizing annealing and recrystallization, or ammonia gas is used at the same time so that decarburizing annealing and nitriding treatment are carried out together.

In decarburizing annealing, and recrystallization and nitriding treatment, the annealing temperature of the steel plate is preferably in a range of 800 to 950° C. When the annealing temperature of the steel plate is low, that is, less than 800° C., it takes a long time for decarburization, and when the heating is above 950° C., recrystallized grains grow coarsely to deteriorate crystal growth driving force so that stable secondary-recrystallized grains are not formed. Further, though the annealing time is not a big problem for showing the effects of the present invention, treatment for 5 minutes or less is generally preferred considering productivity.

Meanwhile, according to the manufacturing method of the present invention, diffusion of aluminum or aluminum-silicon binary molten metal into the inside of the electric steel plate is easy whether the outer oxide layer is present or not, and thus, removing the outer oxide layer does not have to be done.

However, if required, the atmosphere of an annealing furnace may be controlled to a reducing atmosphere immediately before or after finishing decarburizing and nitriding annealing heat treatment, thereby removing some or entire of the outer oxide layer formed on the surface of the decarburizing and nitriding annealed steel plate by reduction. Here, it is preferred that the reducing atmosphere for removing the outer oxide layer is a mixed atmosphere of hydrogen and nitrogen for preventing further oxidation of the steel plate, and the treatment is carried out by heating to a temperature of 100° C. or more for 5 minutes or less considering productivity.

Next, aluminum or aluminum-silicon binary molten metal is hot-dip plated on the steel plate. It is preferred that the temperature when the aluminum or aluminum-silicon molten metal is hot-dip plated is from 600° C. to 900° C. When hot-dip plating at a temperature less than 600° C., hot-dip plating metal is heterogeneously melted to deteriorate hot-dip plating quality, and when above 900° C., surface wettability of the decarburizing and nitriding treated steel plate by the molten metal is lowered to deteriorate the hot-dip plating quality.

When the aluminum-silicon binary metal is used as the molten metal, it is preferred that silicon is included at more than 0 wt % to 60 wt %, preferably at 10 to 30 wt % in the aluminum-silicon binary metal. It is because the primary silicon phase is inevitably produced in the aluminum-silicon binary alloy, but when silicon is contained at more than 60 wt %, the primary silicon phase is excessively produced, so that the hot-dip plated layer is not easily diffused into the electric steel plate.

Here, when the aluminum or aluminum-silicon binary molten metal is hot-dip plated on the steel plate, it is preferred that the unplating ratio of the hot-dip plated layer on the steel plate is 15% or less, preferably 5% or less. When the unplating ratio is above 15%, a local aluminum compositional difference on the steel plate occurs, and the effect of diffusing aluminum of the hot-dip plated layer into the steel plate is reduced.

Thereafter, the surface of the molten metal layer on which aluminum or aluminum-silicon binary molten metal is plated is oxidized to form an oxide layer consisting of an aluminum oxide or an oxide of aluminum-silicon alloy. More specifically, the oxide layer may consist of $SiO_2$, $Fe_2SiO_4$, (Fe, Mn)$SiO_4$, $Al_2O_3$, or (Al,Si)$O_2$ and the like.

Finally, final annealing is carried out generally for a long period to generate secondary recrystallization on the directional electric steel plate, thereby forming {110}<001> aggregation texture in which the {110} plane of the steel plate is parallel to the rolled plane, and the <001> direction is parallel to the rolling direction, and the hot-dip plated aluminum is diffused and infiltrated into the steel plate to increase an aluminum content in the steel plate, thereby manufacturing the directional electric steel plate having excellent magnetic properties. The purpose of final annealing is largely to form {110}<001> aggregation texture by secondary recrystallization, to impart insulation by vitreous coating film formation by the oxidation reaction of the outer oxide layer, to diffuse and infiltrate aluminum from the hot-dip plated layer into the steel plate, and to remove impurities disturbing magnetic properties. For final annealing, in the rising temperature section before secondary recrystallization, mixed gas of nitrogen and hydrogen is maintained to protect nitrides which is a grain growth inhibitor, thereby allowing secondary recrystallization to be well developed, and after completing secondary recrystallization, a 100% hydrogen atmosphere is maintained for a long period to remove impurities.

In the directional electric steel plate manufactured by the manufacturing process as described above, aluminum is diffused into the electric steel plate by hot-dip plating aluminum or aluminum-silicon binary molten metal, so that aluminum is included in the final product at a certain amount, and the aluminum content in the final product may be 0.4 to 5 wt %.

The present invention will be described in more detail in the following Examples. However, the following Examples are only for illustrating the present invention, and the disclosure of the present invention is not limited by the following Examples.

EXAMPLE

Example 1

To a directional electric steel plate containing Si: 3.2 wt %, C: 0.055 wt %, Mn: 0.099 wt %, S: 0.0045 wt %, N: 0.0043 wt %, Sol-Al: 0.028 wt %, P: 0.028 wt %, and remaining components of a balance of Fe and other inevitably contained impurities, a total content of Sb and Sn was added at 0.04 wt % before vacuum dissolving, and after vacuum dissolving, ingot was manufactured, and then heated to a temperature of 1150° C., and hot rolled to a thickness of 2.5 mm. The manufactured hot rolled plate was heated to a temperature of 1070° C., and then maintained at 920° C. at 160 seconds and quenched in water.

The plate material annealed after hot rolling was acid-washed and then single strong cold rolled to a thickness of 0.27 mm, and the cold rolled plate was maintained at a temperature of 860° C. under a wet mixed gas atmosphere of hydrogen, nitrogen and ammonia for 200 seconds and subjected to decarburizing and nitriding annealing heat treatment simultaneously so that a nitrogen content is 180 ppm.

On this steel plate, aluminum melted metal was hot-dip plated and finally annealed, as described in Table 1. The final annealing was performed under a mixed atmosphere of 25% nitrogen+75% hydrogen up to 1200° C., and after reaching 1200° C., a 100% hydrogen atmosphere was maintained for 10 hours or more and then furnace cooling was performed. After final annealing, the Al amount in the steel plate was analyzed and is shown in the following Table 1.

In addition, the cross section photograph of the electric steel plate manufactured in Example 1 is shown in FIG. 1.

As shown in FIG. 1, it is confirmed that steel plate—hot-dip plated layer—oxide layer are sequentially formed.

Examples 2 to 9

The directional electric steel plate was manufactured in the same manner as in Example 1, except that the hot-dip plated metal is binary aluminum-silicon, or the total content of Sb and Sn is different.

Comparative Examples 1 to 5

The directional electric steel plate was manufactured in the same manner as in Example 1, except that the molten metal or the total content of Sb and Sn is different.

The unplating rate and magnetic properties for each detailed process condition of the above Examples and Comparative Examples were measured, and are shown in the following Table 1:

TABLE 1

| Classification | Hot-dip plating alloy | Sb + Sn content (wt %) | Al content after final annealing (wt %) | Core loss (W17/50, W/kg) | Magnetic flux density (B10, Tesla) | Unplating rate |
|---|---|---|---|---|---|---|
| Example1 | aluminum | 0.04 | 2.3 | 0.849 | 1.886 | 2% |
| Example2 | aluminum-25 wt % silicon | 0.04 | 2.2 | 0.837 | 1.881 | 0% |
| Example3 | aluminum-25 wt % silicon | 0.04 | 2.2 | 0.828 | 1.880 | 0% |
| Example4 | aluminum | 0.06 | 2.3 | 0.832 | 1.880 | 0% |
| Example5 | aluminum-25 wt % silicon | 0.06 | 2.2 | 0.839 | 1.887 | 1% |
| Example6 | aluminum | 0.09 | 2.2 | 0.837 | 1.889 | 1% |
| Example7 | aluminum-25 wt % silicon | 0.09 | 2.4 | 0.822 | 1.884 | 0% |

TABLE 1-continued

| Classification | Hot-dip plating alloy | Sb + Sn content (wt %) | Al content after final annealing (wt %) | Core loss (W17/50, W/kg) | Magnetic flux density (B10, Tesla) | Unplating rate |
|---|---|---|---|---|---|---|
| Example8 | aluminum-25 wt % silicon | 0.12 | 2.1 | 0.85 | 1.883 | 1% |
| Example9 | aluminum-25 wt % silicon | 0.14 | 2.1 | 0.853 | 1.887 | 0% |
| Comparative Example1 | aluminum | 0 | 2.1 | 0.844 | 1.881 | 22% |
| Comparative Example2 | aluminum-25 wt % silicon | 0 | 2.1 | 0.846 | 1.886 | 25% |
| Comparative Example3 | aluminum | 0 | 2.4 | 0.829 | 1.889 | 18% |
| Comparative Example4 | aluminum-25 wt % silicon | 0 | 2.4 | 0.836 | 1.884 | 19% |
| Comparative Example5 | aluminum-25 wt % silicon | 0.17 | 0.1 | 1.296 | 1.867 | 0% |

※ Unplating rate measurement: area percentage (%) of delaminated hot-dip plated layer in a 10 cm*10 cm area As shown in Table 1, the unplating rates of the Examples where Sb and Sn were added at a predetermined content, and aluminum or an aluminum-silicon alloy is hot-dip plated were significantly improved as compared with those of the Comparative Examples. Meanwhile, it is recognized that in Comparative Example 5 where the total content of Sb and Sn is more than 0.15 wt %, the unplating rate was excellent, but magnetic properties were deteriorated.

Hereinabove, the present invention is described with reference to the Examples, however, it will be understood by a person with ordinary skill in the art to which the present invention pertains that the present invention may be carried out in other specific embodiments without modifying the technical idea or essential characteristics thereof.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A directional electric steel plate comprising:

a steel plate consisting of Si: 2.0 to 6.5%, acid soluble Al: 0.04 to 5%, Mn: 0.20% or less (0% exclusive), N: 0.010% or less (0% exclusive), S: 0.010% or less (0% exclusive), P: 0.005 to 0.05%, C: 0.04 to 0.12%, both Sb and Sn: 0.01 to 0.15% and a balance of Fe and other unavoidable impurities, by wt %;

a hot-dip plated layer formed on a surface of the steel plate and consisting of an aluminum-silicon alloy; and an oxide layer formed on the hot-dip plated layer and consisting of an oxide of aluminum-silicon alloy, wherein the aluminum-silicon alloy includes more than 0 wt % to 60 wt % of silicon, and wherein the hot-dip plated layer formed on a surface of the steel plate consisting of the aluminum-silicon alloy and the aluminum-silicon alloy includes 10 to 30 wt % of silicon.

2. The directional electric steel plate of claim 1, wherein:

the hot-dip plated layer has an unplating rate of 15 area % or less.

3. A method of manufacturing a directional electric steel plate, comprising:

preparing a steel slab consisting of Si: 2.0 to 6.5%, acid soluble Al: 0.04% or less (0% exclusive), Mn: 0.20% or less (0% exclusive), N: 0.010% or less (0% exclusive), S: 0.010% or less (0% exclusive), P: 0.005 to 0.05%, C: 0.04 to 0.12%, both Sb and Sn: 0.01 to 0.15% and a balance of Fe and other unavoidable impurities, by wt %; reheating the steel slab to a temperature of 1250° C. or less;

subjecting the reheated slab to hot rolling, hot band annealing and cold rolling to manufacture a steel plate; subjecting the cold rolled steel plate to decarburizing annealing and nitriding treatment simultaneously or sequentially; and finally annealing the steel plate subjected to decarburizing annealing and nitriding treatment, wherein during or after the decarburizing annealing and nitriding treatment, hot-dip plating aluminum-silicon binary molten metal, and oxidizing a surface of a hot-dip plated layer are further comprised, wherein the aluminum-silicon alloy hot-dip plated on the steel plate includes more than 0 wt % to 60 wt % of silicon, wherein the aluminum-silicon alloy hot-dip plated on the steel plate includes 10 to 30 wt % of silicon.

4. The method of claim 3, wherein:

the hot-dip plating of aluminum or aluminum-silicon binary molten metal is carried out at a temperature of 600 to 900° C.

5. The method of claim 3, wherein:

the hot-dip plating of aluminum or aluminum-silicon binary molten metal is carried out so that the hot-dip plated layer has an unplating rate of 15% or less.

6. The method of claim 3, further comprising:

reducing some or entire of an outer oxide layer formed on a surface of the decarburizing and nitriding annealed steel plate, before the hot-dip plating of aluminum or aluminum-silicon binary molten metal.

7. The method of claim 3, wherein:

the hot band annealing is carried out by heating to 900 to 1200° C., performing crack heat treatment, and cooling.

8. The method of claim 3, wherein:

the cold rolling is carried out at a cold rolling rate of 87% or more by a single strong cold rolling.

9. The method of claim 3, wherein:

the decarburizing annealing and nitriding treatment is carried out at a temperature of 800 to 950° C.

10. The method of claim 3, further comprising:

coating a magnesium oxide-based or aluminum oxide-based annealing separator before the final annealing.

* * * * *